US005380989A

United States Patent [19]

Ohkubo

[11] Patent Number: 5,380,989

[45] Date of Patent: Jan. 10, 1995

[54] INDUCTIVE HEATING ELEMENT WITH MAGNETIC AND THERMISTOR MATERIALS

[75] Inventor: Atushi Ohkubo, Mie, Japan

[73] Assignee: Fuji Electric Co., Ltd., Kawasaki, Japan

[21] Appl. No.: 35,973

[22] Filed: Mar. 23, 1993

[30] Foreign Application Priority Data

Mar. 26, 1992 [JP] Japan ..... 4-067664
Oct. 9, 1992 [JP] Japan ..... 4-270638

[51] Int. Cl.[6] ..... H05B 6/06

[52] U.S. Cl. ..... 219/667; 219/672; 219/627

[58] Field of Search ..... 219/624, 627, 660, 663, 219/667, 672, 670, 504, 505, 510, 552, 553; 338/22 R, 23, 225 D

[56] References Cited

U.S. PATENT DOCUMENTS 3,715,550 2/1973 Harnden, Jr. et al. ..... 219/667
3,818,184 6/1974 Habfast et al. ..... 219/504
4,351,996 9/1982 Kondo et al. ..... 219/667
4,352,008 9/1982 Höfer et al. ..... 219/540

FOREIGN PATENT DOCUMENTS 64-48669 2/1989 Japan .
2-18559 4/1990 Japan .

*Primary Examiner*—Philip H. Leung
*Attorney, Agent, or Firm*—Brumbaugh, Graves, Donohue & Raymond

[57] ABSTRACT

For heating at a constant temperature, an inductive heating element such as a heating plate includes a magnetic material and a thermistor material, e.g., in layered form or in the form of particles. The thermistor material may be a PTC or a NTC thermistor material. A mixture of PTC thermistor, NTC thermistor, and magnetic particles may be used, e.g., in a proportion for minimized bulk resistance.

10 Claims, 3 Drawing Sheets

INDUCTIVE HEATING ELEMENT WITH MAGNETIC AND THERMISTOR MATERIALS

BACKGROUND OF THE INVENTION

This invention relates to heat-generating bodies which use inductive heating under constant-temperature control.

One known technique for constant-temperature control in inductive heating involves the use of a temperature sensor for detecting the temperature of a heated object, and, based on the detected temperature, adjustment of the electrical power used for inductive heating. In this technique, fitting the sensor may be difficult, and a feedback system for electrical power control may be complex and costly.

Another known technique, illustrated by FIG. 4*a*, 4*b*, 7, 11*a* and 11*b*, is based on changes in the magnetic permeability characteristics of a magnetic substance at its Curie temperature. In cross section, FIG. 4*b* shows a copper plate 7 forming an electrically conductive non-magnetic substrate, and a ferrite laminate 8 of a magnetic material with a specific Curie point. Optionally, a resulting heating element may further include a protective plate 3 laminated to the ferrite. FIG. 4*a* is a plan view of the heating element.

FIG. 7 is a graph of ferrite magnetic permeability as a function of temperature. As shown in the graph, the ferrite magnetic permeability decreases rapidly at temperatures above the Curie temperature (Tc).

FIGS. 11*a* and 11*b* illustrate induced current in an energized state of a heating element placed close to a high-frequency coil 10. As indicated by arrows, currents induced in the copper plate 7 and the ferrite 8 are larger at a lower temperature (FIG. 11*a*) as compared with a higher temperature (FIG. 11*b*).

At low temperatures (FIG. 11*a*), the magnetic resistance in the ferrite 8 is small because its magnetic permeability is large. The alternating magnetic flux is large, and so is the current induced by the magnetic flux in the ferrite. As heat is generated by the induced current, the temperature of the ferrite 8 increases and, due to heat conduction, the temperature of the adjoining copper plate 7 increases also.

With continued heating, the temperature in the ferrite 8 will reach the Curie temperature (Tc), resulting in the high-temperature state shown in FIG. 11*b*. At this point, the magnetic permeability in the ferrite decreases rapidly, so that the magnetic resistance increases sharply. Because of a sharp drop in the alternating magnetic flux, the induced current decreases rapidly, resulting in a drop in the temperature of the ferrite below the Curie temperature (Tc). By this mechanism, the temperature in the heating element composed of copper plate 7 and ferrite layer 8 oscillates above and below the Curie temperature (Tc), and becomes stabilized at that temperature (Tc), which becomes the average temperature.

In this described technique, use of a ferrite entails high material costs. It is an object of the present invention to provide an efficacious, inexpensive constant-temperature inductive heating element.

SUMMARY OF THE INVENTION

For heating at a constant temperature, a preferred inductive heating element such as a heating plate includes a thermistor material and a magnetic material. Such materials may be combined in layer form or admixed as particles. PTC or NTC thermistor materials may be used, individually or in combination.

Other objects, features and advantages of the invention will become apparent, and its construction and operation better understood, from the following detailed description when read in conjunction with the accompanying drawings.

DESCRIPTION OF PREFERRED EMBODIMENTS

Figure 1A:
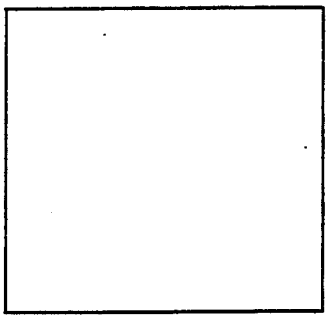
FIG. 1*a* is a top view of an inductive heating element in accordance with a first embodiment of the present invention.

Generally, inductive heating utilizes heat from resistance loss along the path of a current induced in an electric conductor in an alternating magnetic field. The resistance loss is proportional to the square of the induced current. The induced current is proportional to the voltage induced in the current path, and is inversely proportional to the resistance in the current path. The induced voltage is proportional to the time derivative of a closed-loop magnetic flux. The magnetic flux is inversely proportional to the magnetic resistance value in its path, and proportional to the magnetomotive force. The magnetic resistance is inversely proportional to the magnetic permeability in the magnetic flux path. Thus, the induced current is inversely proportional to the resistance in the current path, proportional to the magnetic permeability in the magnetic flux path, and proportional to a current energizing a coil which generates the magnetomotive force.

Generally, when a resistance load is connected to a power supply, the electrical power consumed by the load is maximized when its resistance is the same as the internal resistance of the power supply. If the resistance of the load varies around the internal resistance of the power supply, e.g., as a function of the temperature of the load, the electric power consumed by the load will vary around a maximum value.

Furthermore, when a resistance load is connected to a constant-voltage power supply with small internal resistance, if load resistance takes a minimum value at a specific temperature, it will become possible to maximize the electric power consumed by the load at the specific temperature independent of the internal resistance of the power supply.

Unlike prior-art techniques for constant-temperature control, the present invention relates to the fact that, in a thermistor, resistance varies more rapidly past a specific temperature. Specifically, in the case of a PTC thermistor, resistance steepens up past this temperature. For a NTC thermistor, corresponding steepening is downward. These characteristics can be used for self-adjustment of the electrical power consumed by a heating element including thermistor and magnetic materials, for constant-temperature control near a specific temperature where resistance steepens as a function of temperature.

In an exemplary embodiment, a magnetic material, a PTC thermistor material, and a NTC thermistor material are used in combination, the NTC thermistor material having a specific temperature which is less than the specific temperature of the PTC material, and the proportion of thermistor materials being chosen such that over-all resistance is minimal at a predetermined temperature which lies between the two specific temperatures and at which consumed electrical power is maximized, so that the internal resistance of the power supply need not be determinative in the choice of the bulk resistance of the heating element.

Hereinbelow, specific embodiments of the invention are described with reference to the drawings. Like numerals are used for functionally similar components.

Figure 1B:
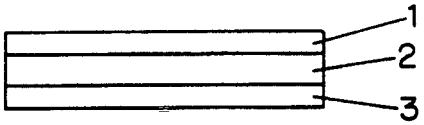
FIG. 1*b* is a lateral cross section of the first embodiment.

FIG. 1*b* shows a layered structure comprising a magnetic body 1 and a PTC thermistor 2, forming a plate-shaped inductive heating element. An optional protective plate 3 is disposed on the thermistor.

Figure 5:
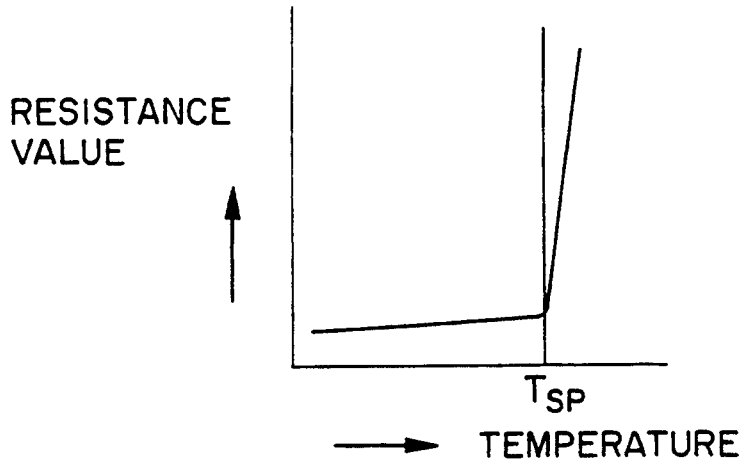
FIG. 5 is a graph of resistance as a function of temperature for a PTC thermistor.

FIG. 5 is a graph showing PTC thermistor temperature-resistance characteristics. As shown, resistance increases rapidly at a temperature higher than a specific temperature (Tsp).

Figure 2A:
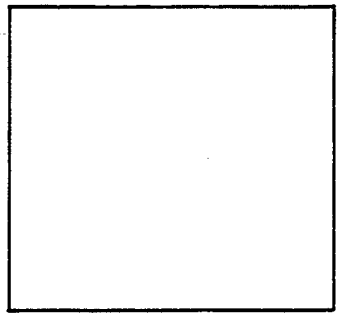
FIG. 2*a* is a top view of an inductive heating element in accordance with a second embodiment of the present invention.
Figure 2B:
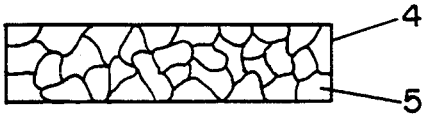
FIG. 2*b* is a lateral cross section of the second embodiment.
Figure 8A:
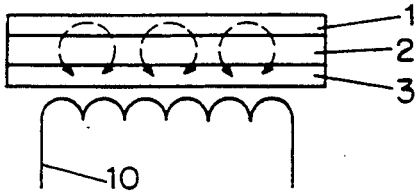
FIGS. 8*a* and 8*b* illustrate an energized state caused by an induced current in the first embodiment of the invention.
Figure 8B:
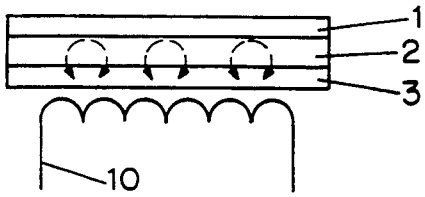

FIG. 8*a* and 8*b* illustrate an energized state with arrows indicating currents, for the inductive heating element of FIGS. 2*a* and 2*b* placed close to a high frequency coil 10. At low temperatures (FIG. 8*a*), because the resistance value in thermistor 2 is small, the induced current flowing through each layer of the heating element is relatively large. As a result, the heating element is heated by a large heat loss generated by the resistance in the energizing path in each layer.

If heating continues until the temperature in the thermistor 2 becomes higher than the specific temperature (Tsp), reaching a high-temperature state (FIG. 8*b*), the resistance value in the thermistor increases rapidly and the induced current decreases sharply. At this point, the temperature in the thermistor decreases slowly as does the temperature in the magnetic body, once again returning to the low-temperature state shown in FIG. 8*a*. The temperature in the heating element fluctuates around the specific temperature (Tsp) and becomes stabilized at the temperature (Tsp), which eventually becomes the average temperature. FIGS. 8*a* and 8*b* show respective large and small induced currents. While the former reach into the magnetic layer, the latter do not.

FIGS. 2*a* and 2*b* show a second embodiment, with PTC thermistor particles and magnetic particles mixed with each other and formed into an inductive heating element. The heating characteristics of this heating element are equivalent to those of the first embodiment.

Figure 9A:
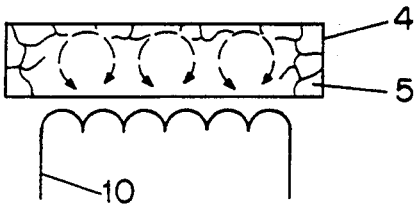
FIGS. 9*a* and 9*b* illustrate an energized state caused by an induced current in the second embodiment of the invention.
Figure 9B:
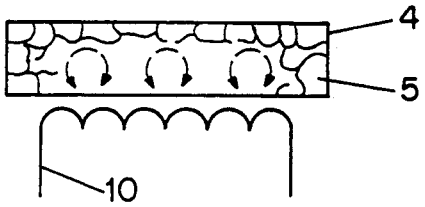

FIGS. 9*a* and 9*b* correspond to FIGS. 8*a* and 8*b*.

Figure 3A:
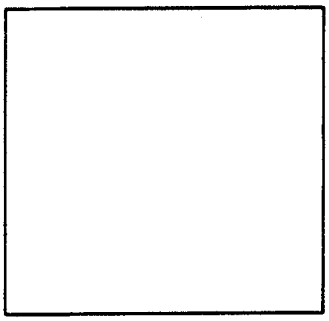
FIG. 3*a* is a top view of an inductive heating element in accordance with a third embodiment of the present invention.
Figure 4A:
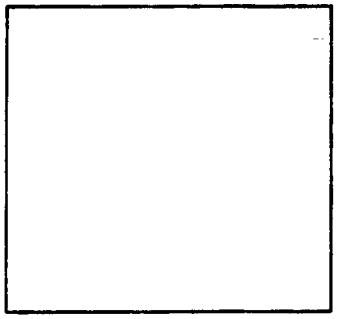
FIG. 4a PRIOR ART
FIG. 4*a* is a top view of a heat generating body based on conventional technology.
Figure 3B:
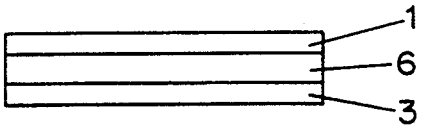
FIG. 3*b* is a lateral cross section of the third embodiment.
Figure 4B:
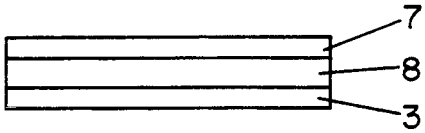
FIG. 4b PRIOR ART
FIG. 4*b* is a lateral cross section of the heat generating body of FIG. 4*a*.

FIGS. 3*a* and 3*b* show a third embodiment, with an NTC thermistor layer 6 instead of the PTC thermistor layer of FIG. 1.

Figure 6:
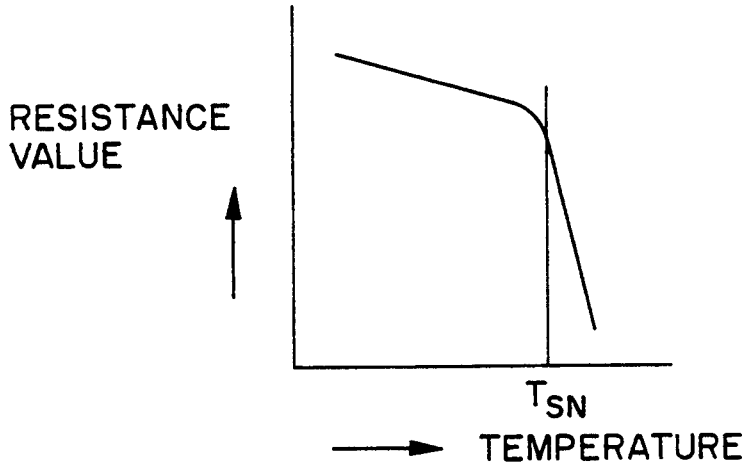
FIG. 6 is a graph of resistance as a function of temperature for a NTC thermistor.
Figure 7:
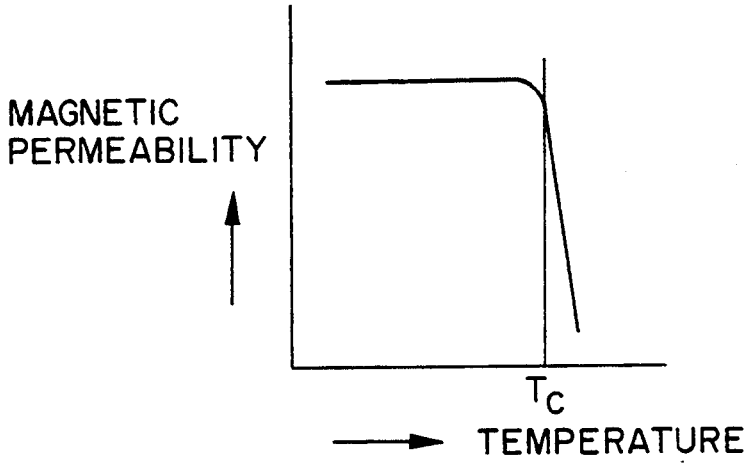
FIG. 7 is a graph of magnetic permeability as a function of temperature for a ferrite.
Figure 10A:
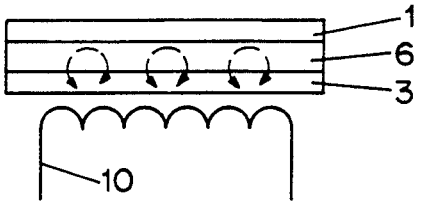
FIGS. 10*a* and 10*b* illustrate an energized state caused by an induced current in the third embodiment of the invention.
Figure 10B:
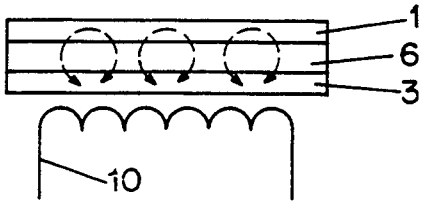
Figure 11A:
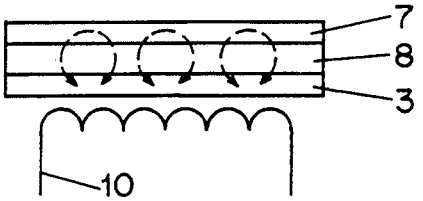
FIG. 11a PRIOR ART
FIGS. 11*a* and 11*b* illustrate an energized state caused by an induced current in the heat-generating body of FIGS. 2*a* and 2*b*.
Figure 11B:
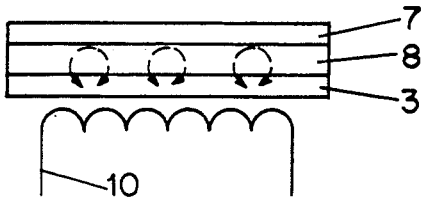
FIG. 11b PRIOR ART

FIG. 6 shows NTC thermistor temperature-resistance characteristics. As can be seen, resistance decreases rapidly at a temperature higher than the specific temperature (Tsn). Accordingly, as shown in FIGS. 10*a* and 10*b* , an energized state caused by the induced current in the heating element of FIGS. 3*a* and 3*b* placed close to the high-frequency coil 10, the low- and high-temperature states are reversed as compared with FIGS. 8*a* and 8*b*.

The increase in the current associated with the sudden decrease in the thermistor resistance at a temperature higher than the temperature (Tsn) causes a simultaneous reduction in the electric power consumed in the thermistor as described above. The temperature in the heating element decreases, and the temperature moves from the high temperature shown in FIG. 10*b* to the low temperature shown in FIG. 10*a*. The temperature in the heating element fluctuates around the temperature (Tsn) and becomes stabilized at said temperature (Tsn), which becomes the average temperature.

In a fourth embodiment of the present invention, which is not shown, NTC thermistor particles and magnetic particles are mixed with each other, and the mixture formed into an inductive heating element in which the PTC thermistor particles 5 in the second embodiment shown in FIGS. 2*a* and 2*b* are replaced with NTC thermistor particles. In this case, the energized states caused by the induced current have the low- and high-temperatures shown in FIGS. 9*a* and 9*b* reversed.

Furthermore, in a fifth embodiment of the present invention, which is not shown, PTC thermistor particles, NTC thermistor particles, and magnetic particles are mixed with each other in a suitable ratio, and formed into an inductive heating element as shown in FIG. 2*b*. The overall resistance value in the heating element is minimized at a predetermined temperature between the respective sudden-resistance-change temperatures of both thermistors. For the predetermined temperature, the energized state caused by the induced current is shown in FIG. 9*a*. For temperatures around the predetermined temperature, the energized state is shown in FIG. 9*b*.

I claim:

1. An inductive heating device for heating at a characteristic constant temperature, comprising a heating element and induction means operatively coupled to the heating element for inducing current flow in the heating element, the heating element including a thermistor material and a magnetic material disposed to permit an induced current to flow between the thermistor material and the magnetic material.

2. The inductive heating device of claim 1, wherein the heating element is plate shaped.

3. The inductive heating device of claim 1, wherein the thermistor material and the magnetic material form layers in a layered structure.

4. The inductive heating device of claim 3, wherein the thermistor layer and the magnetic layer are adjacent.

5. The inductive heating device of claim 3, further comprising a protective layer adjacent to the thermistor layer.

6. The inductive heating device of claim 1, wherein the thermistor material is a PTC thermistor material.

7. The inductive heating device of claim 1, wherein the thermistor material is a NTC thermistor material.

8. The inductive heating device of claim 1, wherein the thermistor material and the magnetic material are in the form of particles.

9. The inductive heating device of claim 8, wherein a first portion of the thermistor particles are PTC thermistor particles, a second, complementary portion of the thermistor particles are NTC thermistor particles, and the first and second portions are chosen for minimized resistance of the heating element at a predetermined temperature.

10. The inductive heating device of claim 1, wherein the thermistor material and the magnetic material are in mutual contact.

* * * * *

UNITED STATES PATENT AND TRADEMARK OFFICE

CERTIFICATE OF CORRECTION

PATENT NO. : 5,380,989

DATED : January 10, 1995

INVENTOR(S) : Atushi Ohkubo

It is certified that error appears in the above-indentified patent and that said Letters Patent is hereby corrected as shown below:

Column 2, line 47, "2a and 2b" should read --4a and 4b--;

Column 4, line 44, "temperatures" should read --temperature states--.

Signed and Sealed this

Second Day of May, 1995

Bruce Lehman

*Attest:*

BRUCE LEHMAN

*Attesting Officer*

*Commissioner of Patents and Trademarks*